US008313316B2

(12) United States Patent
Bade et al.

(10) Patent No.: US 8,313,316 B2
(45) Date of Patent: Nov. 20, 2012

(54) COMPRESSOR SYSTEM FOR UNDERWATER USE HAVING A STATOR PACKET WITH AN ANNULAR COOLING CHAMBER

(75) Inventors: Maria Bade, Berlin (DE); Joachim Mucha, Berlin (DE); Axel Möhle, Berlin (DE)

(73) Assignee: Siemens Aktiengesellschaft, München (DE)

( * ) Notice: Subject to any disclaimer, the term of this patent is extended or adjusted under 35 U.S.C. 154(b) by 267 days.

(21) Appl. No.: 12/599,160

(22) PCT Filed: May 7, 2008

(86) PCT No.: PCT/EP2008/055629

§ 371 (c)(1),
(2), (4) Date: Nov. 6, 2009

(87) PCT Pub. No.: WO2008/138829

PCT Pub. Date: Nov. 20, 2008

(65) Prior Publication Data

US 2010/0239441 A1 Sep. 23, 2010

(30) Foreign Application Priority Data

May 9, 2007 (DE) ..... 10 2007 021 720

(51) Int. Cl.
*H02K 9/197* (2006.01)

(52) U.S. Cl. ..... 417/423.8; 310/58

(58) Field of Classification Search ..... 417/410.1, 417/366, 423.1, 423.3, 423.8; 310/54, 58
See application file for complete search history.

(56) References Cited

U.S. PATENT DOCUMENTS

| | | | | |
|---|---|---|---|---|
| 1,269,909 | A * | 6/1918 | Cooper | 310/86 |
| 1,448,700 | A * | 3/1923 | Seidner | 310/54 |
| 2,844,745 | A * | 7/1958 | Hamm | 310/57 |
| 2,975,309 | A * | 3/1961 | Seidner | 310/54 |
| 3,704,078 | A * | 11/1972 | Conery et al. | 417/369 |
| 3,790,309 | A * | 2/1974 | Volz | 417/368 |
| 4,652,218 | A * | 3/1987 | Tsutsui et al. | 417/368 |
| 5,250,863 | A * | 10/1993 | Brandt | 310/54 |
| 5,795,135 | A * | 8/1998 | Nyilas et al. | 417/53 |
| 6,059,539 | A * | 5/2000 | Nyilas et al. | 417/228 |
| 6,364,620 | B1 * | 4/2002 | Fletcher et al. | 417/36 |
| 7,423,356 | B2 * | 9/2008 | Kalsi et al. | 310/52 |

(Continued)

FOREIGN PATENT DOCUMENTS

DE 3729486 C1 12/1988

(Continued)

*Primary Examiner* — Devon Kramer
*Assistant Examiner* — Nathan Zollinger
(74) *Attorney, Agent, or Firm* — Henry M. Feiereisen LLC

(57) ABSTRACT

The invention relates to a compressor system (1), particularly for conveying gases or gas/oil mixtures in the offshore area, with a seawater-tight housing (2) with at least one access opening (3) for gases or gas/oil mixtures which are to be compressed, and with at least one outlet opening (4) for the compressed gases or gas/oil mixtures. In the housing (2), a compressor (8) is disposed, which is connected at the inlet side to the access opening (3) and, at the outlet side, to the outlet opening (4). An electric motor (7), which has a stator assembly (71) and a rotor assembly (72) for driving the compressor (8), is disposed in the housing (2). According to the invention, the stator assembly (71) can be cooled over an inner side (GI) of the housing (2) of the compressor system (1).

7 Claims, 4 Drawing Sheets

U.S. PATENT DOCUMENTS

| | | | | |
|---|---|---|---|---|
| 2007/0200440 | A1 * | 8/2007 | Kalsi et al. | 310/54 |

FOREIGN PATENT DOCUMENTS

| | | | |
|---|---|---|---|
| DE | 4209118 | A1 | 7/1993 |
| DE | 19623553 | A1 | 12/1997 |
| FR | 1181680 | A | 6/1959 |
| RU | 2034999 | C1 | 5/1995 |
| RU | 2072609 | C1 | 1/1997 |
| RU | 2205129 | C2 | 5/2003 |
| SU | 1056376 | A1 | 11/1983 |
| WO | WO 9429597 | A1 | 12/1994 |

* cited by examiner

COMPRESSOR SYSTEM FOR UNDERWATER USE HAVING A STATOR PACKET WITH AN ANNULAR COOLING CHAMBER

CROSS-REFERENCES TO RELATED APPLICATIONS

This application is the U.S. National Stage of International Application No. PCT/EP2008/055629, filed May 7, 2008, which designated the United States and has been published as International Publication No. WO 2008/138829 and which claims the priority of German Patent Application, Serial No. 10 2007 021 720.1, filed May 9, 2007, pursuant to 35 U.S.C. 119(a)-(d).

BACKGROUND OF THE INVENTION

The invention refers to a compressor system, especially for transporting gases or gas/oil mixtures in the offshore area. The compressor system has a seawater-proof housing with at least one entry opening for gases or gas/oil mixtures which are to be compressed and with at least one discharge opening for the compressed gases or gas/oil mixtures. It has a compressor which is arranged in the housing and which on the inlet side is connected to the entry opening and on the outlet side is connected to the discharge opening. An electric motor is arranged in the housing, with a stator packet and a rotor packet for driving the compressor.

Offshore transporting, that is to say the transporting of oil and gas in coastal waters, makes high demands on compressor systems. They must stand up to harsh climate, corrosive environmental conditions and also to unpredictable gas compositions. The compressor systems can be driven by an electric motor or by a gas turbine. The electric motor is preferably a brushless asynchronous motor. For compressing, a high-speed turbine is customarily used, wherein in this case the turbine and the electric motor are preferably arranged on a common shaft. The brushless and gearless drive allows an almost maintenance-free operation of such compressor systems. Alternatively, screw compressors or piston compressors can also be used for compressing.

The considered compressor systems can be installed in petrochemical facilities on the coast, on drilling platforms or even under water. In the last case, driving the compressor is typically carried out by an electric motor.

Supplying of the gas or of the gas/oil mixture is customarily carried out via a pipeline which is flanged on the housing outer side of the compressor system. In a corresponding manner, the further transporting of the compressed gas or gas/oil mixture on the outlet side is carried out via a further pipeline. Alternatively, a pressure hose can be used instead of a pipeline.

The high electrical connected load of the electric motors which are used in the region of more than 100 kW necessitates cooling of the electric motors. An oil cooling system, which as a separate unit is connected to the compressor system via oil feed lines and oil return lines, is customarily used. Such compressor systems are disadvantageously extensive on account of the externally arranged oil cooling systems.

A further disadvantage is that the external oil cooling systems can become unsealed with time. For one thing, the oil feed lines and the oil return lines themselves can become unsealed, especially as a result of seawater-induced corrosion or as a result of mechanical actions, such as a result of the dashing of waves. For another thing, connections, which are constructed in a pressure-tight manner, of the pipelines on the housing of the compressor system can also become unsealed with time. Escaping oil and also oil/gas mixtures constitute a potential ecological hazard for the surrounding water in this connection.

SUMMARY OF THE INVENTION

It is an object of the invention to disclose a compressor system in which the previously described disadvantages are avoided.

The object of the invention is achieved by a compressor system, especially for transporting gases or gas/oil mixtures in the offshore area, including a seawater-proof housing with at least one entry opening for the gases or gas/oil mixtures which are to be compressed, and with at least one discharge opening for the compressed gases or gas/oil mixtures, a compressor (8) which is arranged in the housing and which on the inlet side is connected to the entry opening and on the outlet side is connected to the discharge opening, and an electric motor, which is arranged in the housing, with a stator packet and a rotor packet for driving the compressor, wherein the stator packet of the electric motor can be cooled via an inner side of the housing of the compressor system.

According to the invention, the stator packet of the electric motor can be cooled via an inner side of the housing of the compressor system.

The advantage is associated with the fact that no external oil cooling system is required. As a result of the integration of the cooling system in the compressor system the space requirement is reduced significantly. Since the largest part of the heat loss which occurs in the electric motor occurs in the stator packet, this can be dissipated virtually at the point of origin and via the wall of the housing of the compressor system discharged to the seawater which washes around the housing. The aforementioned heat loss in the stator packet originates primarily from electrical losses of a current coil which is built in the stator packet, and also from hysteresis losses in the stator packet which is typically constructed as a laminated core.

A further great advantage is that the risk of contamination of the environment is significantly reduced since all the components of the cooling system are accommodated in the housing. There are no potentially unsealed connecting points whatsoever for the connecting of an otherwise necessary oil cooling system on the housing.

According to one embodiment of the compressor system, the stator packet of the electric motor has a stator outer side which abuts at least almost flush against the housing inner side. A substance with good thermal conductivity is introduced between the stator outer side and the housing inner side. The substance with good thermal conductivity for example can be a thermally conductive paste or a plastic with good thermal conductivity. Consequently, the heat transfer resistance from the stator packet to the housing is noticeably reduced. Cooling of the electric motor is improved.

According to an alternative preferred embodiment, the stator packet is at a distance from the inner side of the housing. The stator packet with at least one oppositely-disposed part of the housing inner side in this case forms an annular cooling chamber. A cooling medium is provided in the cooling chamber.

The heat transfer resistance from the stator packet to the housing is dramatically reduced on account of the complete embedding of the stator packet in the cooling medium and on account of the wetting of the housing inner side with the cooling medium. The reason for this is that the stator packet with its particularly hot points, such as with its axially projecting end windings, is completely immersed in the cooling medium. The cooling of these hot and critical points is therefore especially effective. Directions which are parallel to the rotational axis of the electric motor are referred to as "axial".

The cooling medium is preferably a liquid, especially an oil, such as a silicon oil or mineral oil. In addition to the high specific thermal capacity, this advantageously acts in an electrically insulating manner with regard to the live end windings. Alternatively, other cooling liquids can be used, such as cooling liquids on a water base. The cooling medium can alternatively be a refrigerant, such as Freon® R134a. In this case, the cooling medium is a solution, that is to say a liquid/gas mixture.

According to a further embodiment, cooling passages which extend essentially axially to the rotational axis of the electric motor are provided in the stator packet. As a result, cooling inside the stator packet is advantageously possible.

According to a further embodiment, the compressor system has a circulating pump for the cooling medium. As a result of the circulation, a more uniform and also higher cooling capacity is achieved.

According to one preferred embodiment, the compressor system for the as-intended application is installed in such a way that the rotational axis of the electric motor extends essentially in the vertical direction. The same applies to the cooling passages. The current arrangement creates the effect of a cooling circuit being automatically established inside the cooling chamber because heating of the cooling medium in the respective cooling passages creates the effect of this rising and flowing out of the upper axial end face of the stator packet. Inflowing cooling medium forcibly transports the heated cooling medium to the housing inner side which is cold in comparison to the cooling medium temperature. The subsequent cooling down brings about an increase of the specific weight and sinking of the cooling medium. Having reached the lower end of the cooling chamber, the cooled cooling medium is drawn in in the direction towards the axial lower end face of the stator packet. The cooling circuit is therefore closed. In this case, the cold seawater which washes around the housing outer side, with typical temperatures in the single-digit Celsius range, acts as a heat sink. The large temperature gradient between heated cooling medium and cold seawater brings about a large heat flow from the cooling medium via the housing wall to the seawater.

For the purposeful guiding of the circulating liquid flow which develops in the cooling chamber baffle plates can also be arranged for example on the axial ends of the stator packet.

According to a further advantageous embodiment, the housing has a housing outer side on which a multiplicity of cooling fins are arranged. The cooling fins bring about a significant increase of the cooling surface towards the seawater. The increased cooling surface, depending upon design and number of available cooling fins, can be a multiple of the otherwise existing outer surface of the housing of the compressor system. The cooling fins preferably point away from the outer side of the housing.

The housing preferably has a cylindrical structural shape. In this case, the cooling bodies point radially away from the housing outer side. Directions towards the symmetry axis of the cylindrical housing and away from it are referred to as "radial". The symmetry axis typically coincides with the rotational axis of the electric motor.

BRIEF DESCRIPTION OF THE DRAWING

Further advantageous characteristics of the invention result from its exemplary explanation with reference to the figures. In the drawing

DETAILED DESCRIPTION OF PREFERRED EMBODIMENTS

Figure 1:
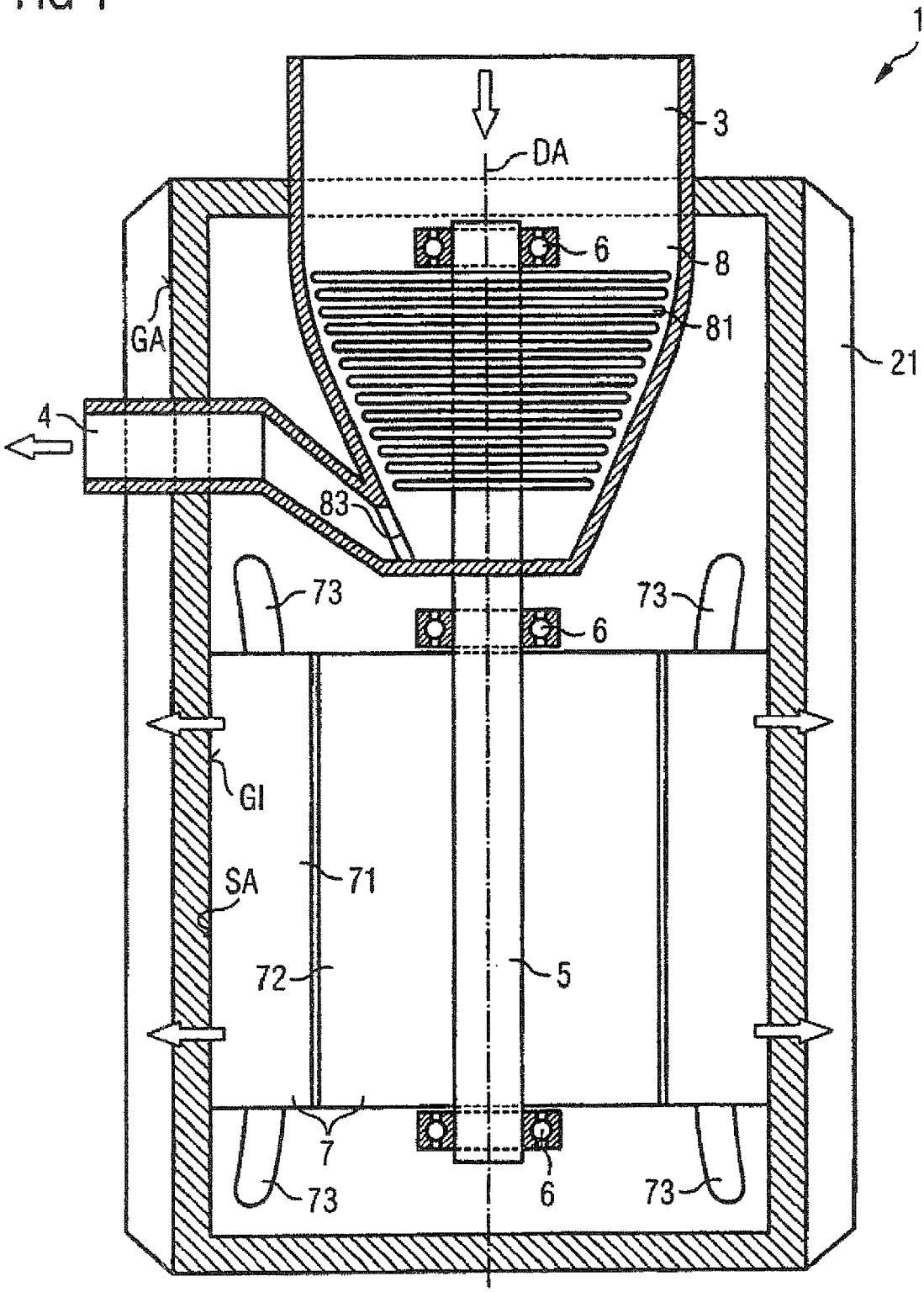
FIG. 1 shows a sectional view of a compressor system along the rotational axis of an electric motor and of a compressor according to a first embodiment of the invention.

FIG. 1 shows a sectional view of a compressor system 1 along the rotational axis DA of an electric motor 7 and of a compressor 8 according to a first embodiment of the invention.

Figure 2:
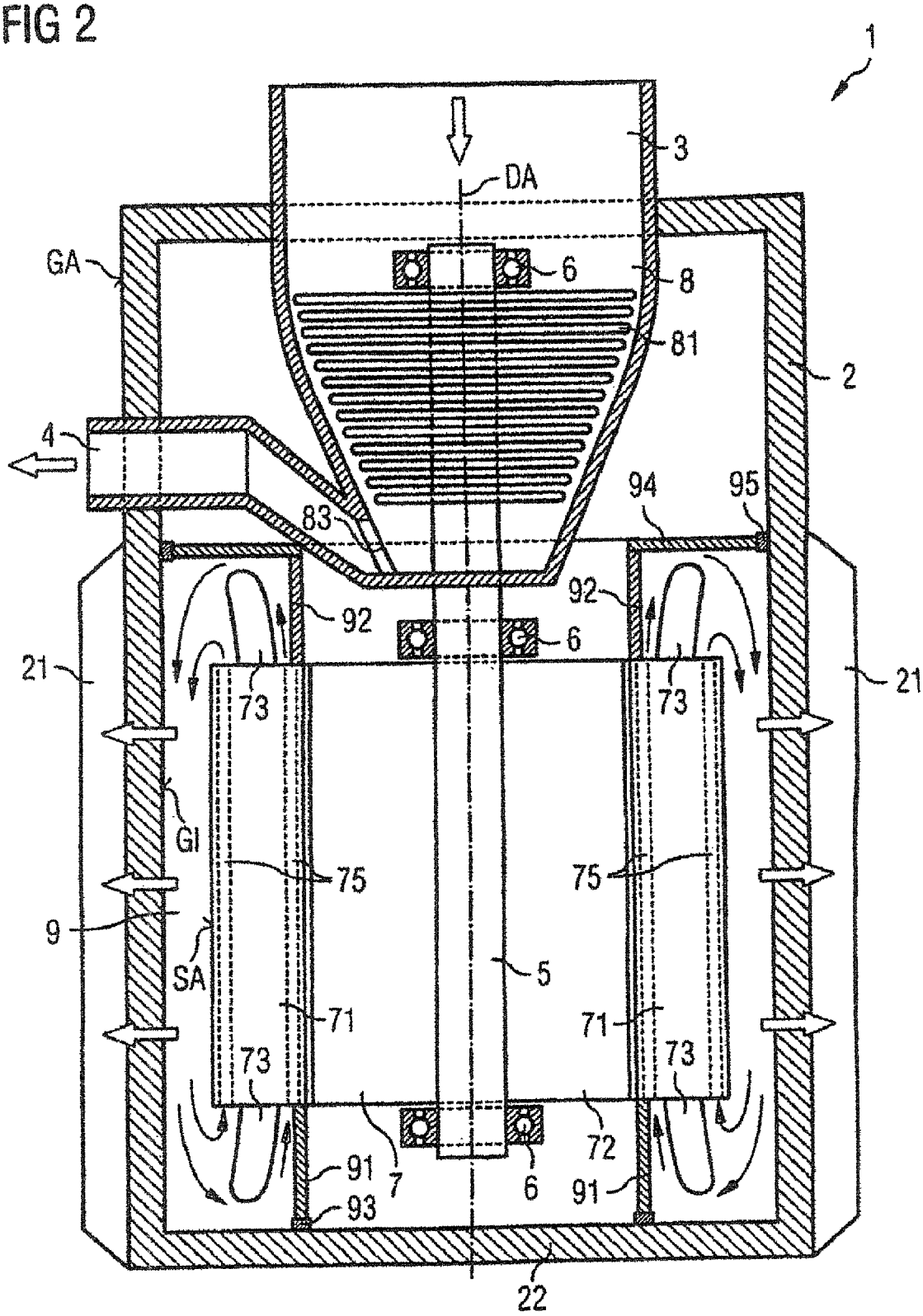
FIG. 2 shows a sectional view of a compressor system according to a second embodiment of the invention.
Figure 3:
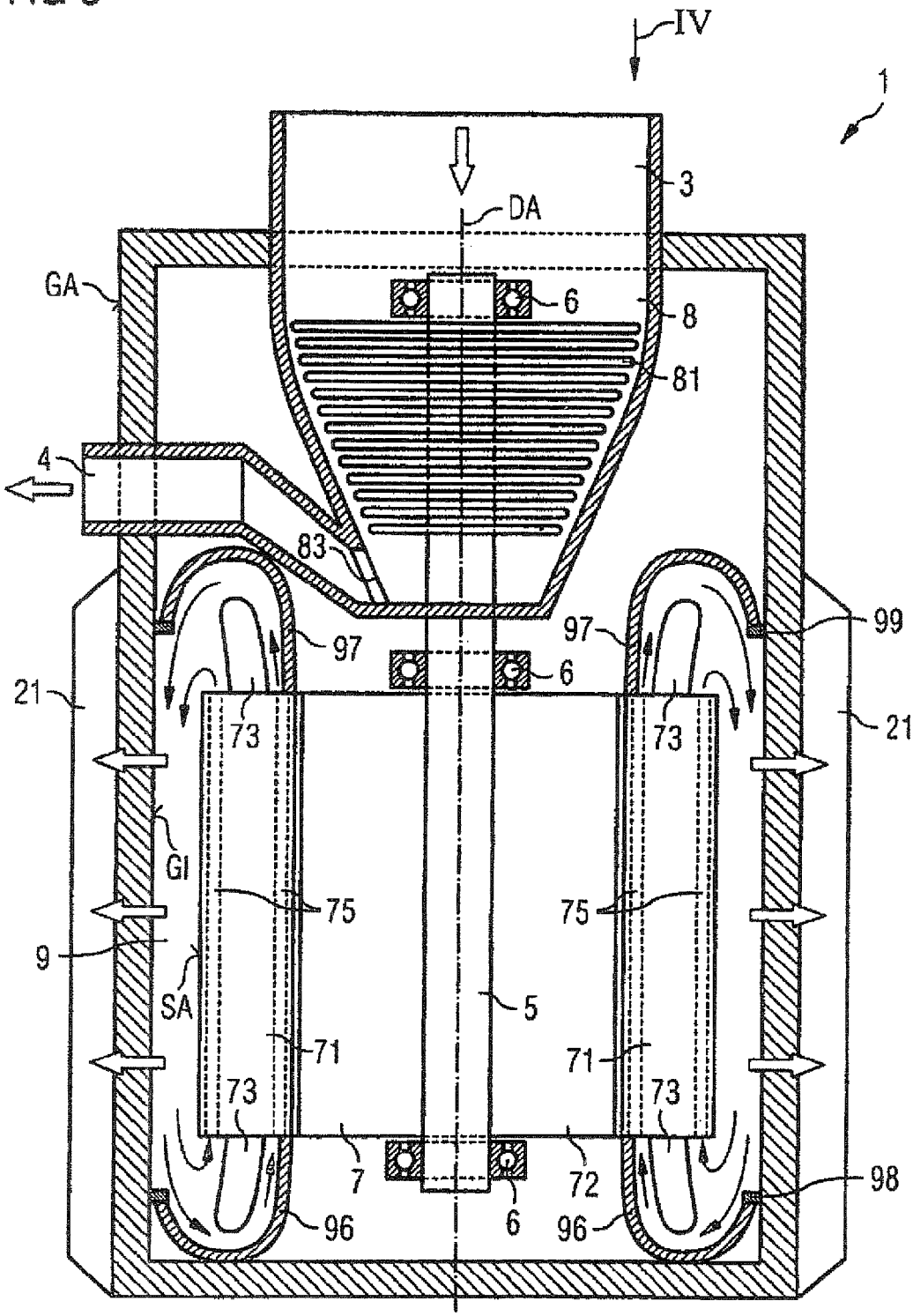
FIG. 3 shows a sectional view of a compressor system according to a third embodiment of the invention.

The compressor systems which are shown in the figures FIG. 1 to FIG. 3 are especially designed for transporting gases and/or gas/oil mixtures in the offshore area. In particular, a housing 2 is constructed in a seawater-proof manner. The housing 2 is preferably produced from steel and can have a protective coating of paint for avoiding corrosion. The steel which is used can alternatively or additionally be stainless steel. Alternatively, the housing 2 can be produced from a seawater-proof aluminum. The housing is preferably constructed in a pressure-tight manner, specifically corresponding to the operating depth beneath the seawater surface or on the seabed which is provided for the operation of the compressor system 1. The pressure-tight requirements affect not only the housing 2 itself but also bushings in the housing, such as for power and control cables for power supply and for controlling and/or monitoring the compressor system 1.

The housing 2 exemplarily has an entry opening 3 for the gases or gas/oil mixtures which are to be compressed, and a discharge opening 4 for the compressed gases or gas/oil mixtures. A plurality of openings 3, 4 can alternatively also be provided. Connecting elements, such as couplings or flanges, are customarily attached at the two openings 3, 4 in order to be able to connect pipelines or pressure hoses to these. The connecting elements and also the pipelines, with regard to the pressure-tightness which is required in each case, are to be correspondingly constructed in a technically robust manner.

The compressor 8, which on the inlet side is connected to the entry opening 3 and on the outlet side is connected to the discharge opening 4, is arranged in the housing 2. The arrows which are shown in the region of the openings 3, 4 indicate the flow directions. In the example of FIG. 1, the compressor 8 has a turbine 81 with turbine blades which are not identified further. Their diameter reduces in the axial direction, that is to say in the flow direction, wherein the pressure increases at the same time as a result of the compression. A high-pressure outlet is identified by the designation 83. From there, via a pipe connection, which is not identified further, inside the housing 2, the transporting of the compressed gas to the discharge opening 3 is carried out.

The electric motor 7 for driving the compressor 8 is furthermore arranged in the housing 2. The electric motor 7 has a stator packet 71 and also a rotor packet 72. Furthermore, in the example of FIG. 1 both the compressor 8 and the electric motor 7 have a common shaft 5 which is guided in bearings 6.

According to the invention, the stator packet 71 of the electric motor 7 can be cooled via a housing inner side GI of the housing 2 of the compressor system 1. In the example of FIG. 1, the cooling is carried out via a stator outer side SA which abuts in a flush manner against the housing inner side GI. The arrows which are drawn in in the contact region between stator outer side SA and housing inner side GI represent the heat flow. In order to increase the cooling capacity, a substance with good thermal conductivity, such as a paste, a grease or such like with good thermal conductivity, can be introduced between the stator outer side SA and the housing inner side GI.

The compressor system 1 which is shown is installed in such a way that the rotational axis DA of the electric motor 7 extends essentially in the vertical direction. It can alternatively also be oriented in the horizontal position.

Furthermore, the housing 2 has a housing inner side GA on which a multiplicity of projecting cooling fins 21 are arranged. In the current case of a cylindrical structural shape of the housing 2 the cooling fins 21 point radially away from the housing outer side GA. The alternative embodiments of the compressor system 1 according to FIG. 2 and FIG. 3 also have such a cylindrical structural shape.

FIG. 2 shows a sectional view of a compressor system 1 according to a second embodiment of the invention. The compressor system 1 which is shown is again vertically installed with regard to the rotational axis DA of the electric motor 7.

In contrast to the embodiment according to FIG. 1, the stator packet 71 is at a distance from the inner side GI of the housing 2. The average radial distance lies preferably within a range of 5 cm to 15 cm. Depending upon the electrical connected power of the electric motor 7, the distance values can lie either above it, such as at 20 cm, or below it, such as at 3 cm. The stator packet 71 with at least one oppositely-disposed part of the housing inner side GI forms an annular cooling chamber 9 in which a cooling medium 9 is provided. The end windings 73 of the stator packet 71, which project axially from the stator packet 71, also lie within the cooling chamber 9. The cooling chamber 9 in the example of FIG. 2 has only one chamber. It can alternatively have a plurality of chambers, wherein in this case adjacent chambers are separated from each other in each case by means of a radially-axially extending partition.

The cooling chamber 9 is formed by means of two rings 91, 92 and a circular disk 94. The two rings 91, 92 have an inside diameter which corresponds to the inside diameter of the stator packet 71. The first ring 91 is attached in a sealed manner, such as welded, on a lower axial end face of the stator packet 71. The symmetry axis of this ring 91 aligns with the rotational axis DA of the electric motor 7. The axial height of the first ring 91 almost corresponds to the axial distance of the stator packet 71 to a baseplate 22 of the housing 2. The lower edge of the first ring 91 can be sealed via a sealing ring 93 to the baseplate 22 or can be welded to the baseplate 22 with sealing effect.

The second ring 92 is attached in a corresponding manner on the upper axial end of the stator packet 71. The circular disk 94 has an inside diameter which corresponds approximately to the inside diameter of the rings 91, 92. The outside diameter corresponds approximately to the inside diameter of the housing 2. The second ring 92 and the circular disk 94 are preferably welded to each other with sealing effect and together form a flange 92, 94. The outer edge of the circular disk 94 or of the flange 92, 94 can be sealed via a further sealing ring 95 to the housing inner side GI or can be welded to the housing inner side GI with sealing effect. The rings 91, 92, the circular disk 94, a radial inner side of the stator packet 71 and the housing inner side GI therefore form a hollow cylinder.

A cooling medium, preferably an oil, is provided as cooling liquid in the cooling chamber 9. A so-called transformer oil on a mineral oil base or silicon oil base especially comes into consideration. The entire cooling chamber 9 is preferably filled with the cooling liquid. In the housing 2 and outside the cooling chamber 9, a compensating vessel for the cooling liquid can be provided in order to compensate a temperature-induced volume change of the cooling medium.

Alternatively to oil, the cooling medium can also be a refrigerant, such as Freon®. FCKW-free Freon®, such as Freon® R134a, is particularly advantageous with regard to environmental friendliness. In this case, the cooling chamber 9 is filled with a solution, that is to say with a liquid/gas mixture.

Furthermore, cooling passages 75, which extend essentially axially to the rotational axis DA of the electric motor 7, are provided in the stator packet 71. On account of the embedding of the stator packet 71 in the cooling medium, these passages are likewise filled with the cooling medium. During operation of the compressor system 1, a circulation of the cooling medium inside the cooling chamber 9 is established. This is represented by means of flow arrows. During this, the cooling medium which is heated in the cooling passages 75 rises upwards and is cooled down again in the reverse direction from the top downwards along the cold housing inner side GI. In so doing the thermally especially critical end windings 73 are washed around by the circulating cooling medium and effectively cooled as a result.

The horizontal arrows symbolize the transporting of heat from the cooling medium, continuing via the wall of the housing 2 into the seawater which washes around the outer side GA of the housing 2. The cooling circuit which is established in the cooling chamber 9 can also be referred to as the primary cooling circuit, while on the housing outer side, but only in the case of still water, a counterflow is established which sweeps from the bottom upwards along the housing outer side GA. The cooling by means of the seawater can also be referred to as secondary cooling.

For further increase of the cooling capacity, the compressor system 1 can have a circulating pump for the cooling medium. The circulating pump for example is a centrifugal pump which is attached in or on the cooling chamber 9.

In comparison to FIG. 1, the cooling fins 21 on the outer side GA of the housing 2 are formed shorter with regard to their length. The fins extend only in the axial "hot" region of the housing 2 which lies opposite the cooling chamber 9. Cooling of the compressor 8 in this connection is carried out via the gases or gas/oil mixtures themselves which are to be compressed.

FIG. 3 shows a sectional view of a compressor system 1 according to a third embodiment of the invention.

In comparison to FIG. 2, the cooling chamber 9 is formed essentially with a toroidal shape, wherein the cooling chamber 9 has curved cooling chamber walls 96, 97 which on account of their shape have a positive influence on the circulating flow characteristic. The cooling capacity of this embodiment is therefore greater in comparison to the second embodiment with the same structural volume. The cooling chamber walls 96, 97, in addition to forming the cooling chamber 9, also fulfill a flow guiding function. Further sealing rings for sealing the cooling chamber walls 96, 97 to the housing inner side GI are identified by the designations 98, 99. Alternatively, the cooling chamber walls 96, 97 can be welded to the housing inner side GI with sealing effect.

Figure 4:
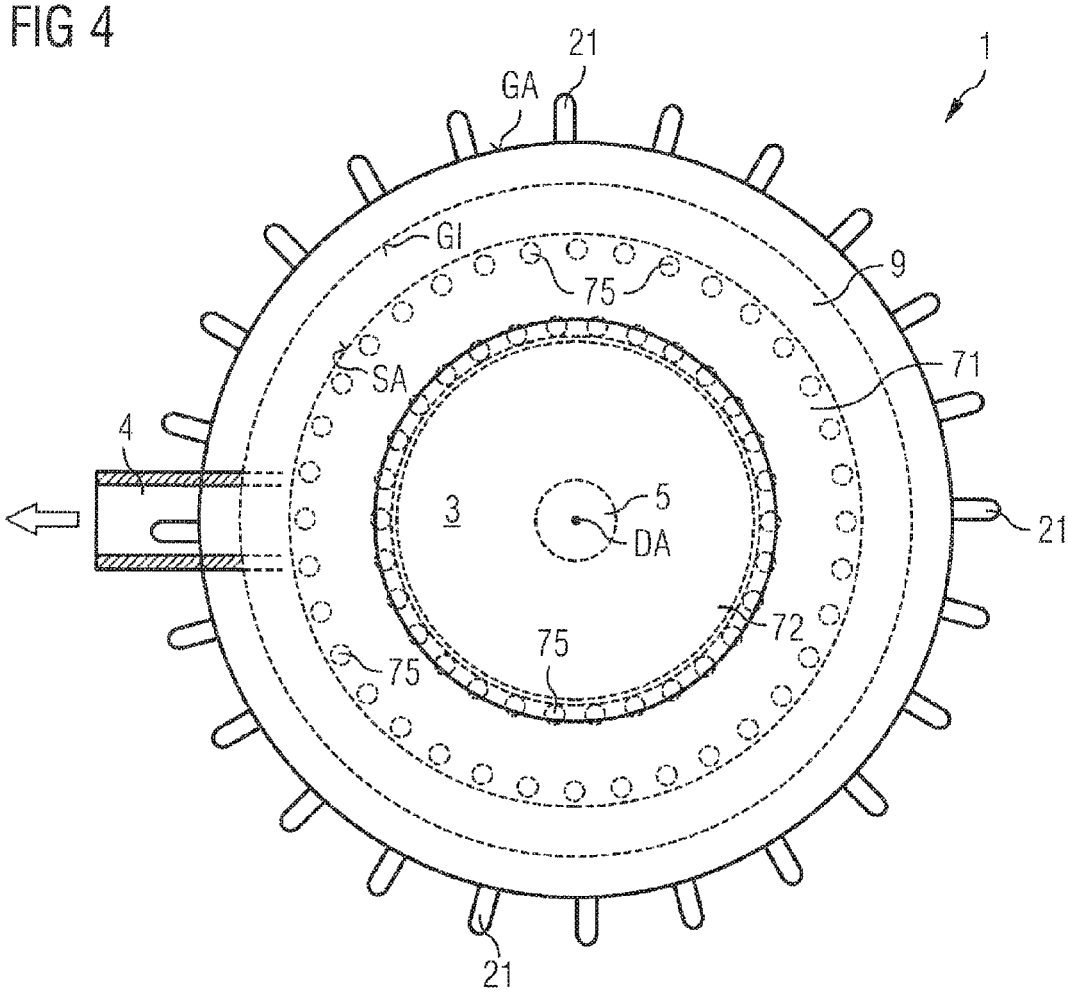
FIG. 4 shows a side view of the compressor system according to FIG. 3 corresponding to the direction of view IV which is marked in FIG. 3.

FIG. 4 shows a side view of the compressor system 1 according to FIG. 3 in accordance with the direction of view IV which is marked in FIG. 3.

FIG. 4 shows the view into the entry opening 3, that is to say in the direction of the compressor. As FIG. 4 further shows, the stator packet 71 has a multiplicity of cooling passages 75 which are arranged in a uniformly distributed manner in the circumferential direction. The cooling passages 75 are arranged on the two sides of the end windings 73 with regard to their radial position in relation to the end windings 73 (also compare FIG. 2 and FIG. 3 with this). The arrangement of the cooling passages 75 is preferably carried out in the magnetically less active region of the stator packet 71. The multiplicity of cooling passages 75 enables effective cooling of the stator packet 71 virtually from the inside.

A multiplicity of cooling fins 21, which are arranged in a manner in which they point radially away from the housing outer side, are to be seen on the housing outer side GA. The cooling fins 21 bring about a dramatic increase of the cooling surface which is available for cooling the seawater. The cooling fins 21 are preferably an integral component part of the housing 2 of the compressor system 1. The housing 2 is especially produced from a casting.

The compressor system according to the invention is also suitable for high-speed compressor systems with speeds of up to 15000 rpm and outputs from several hundred kW up to 10 MW and more.

What is claimed is:

1. A compressor system for transporting a medium in an offshore area, comprising:

a seawater-proof housing having at least one entry opening for the medium, and at least one discharge opening for the medium;

a compressor arranged in the housing and having an inlet side connected to the entry opening and an outlet side connected to the discharge opening; and an electric motor arranged in the housing and including a stator packet coolable via an inner side of the housing and a rotor packet for driving the compressor, said stator packet being spaced at a distance from the inner side of the housing and having cooling passages extending axially inside the stator packet, said stator packet forming with at least one confronting part of the housing inner side a separate closed annular cooling chamber arranged at an inner peripheral area of the housing and fluidly communicating with both ends of the cooling passages to thereby enable circulation of a coolant in a closed cooling circuit, wherein the coolant is oil, wherein the cooling passages are spaced from one another to define one cooling passage arranged at an inner diameter of the stator packet and another cooling passage arranged at an outer diameter of the stator packet; and wherein the rotor packet is located externally of the annular cooling chamber.

2. The compressor system of claim 1, wherein the medium is a gaseous fluid or a gas/oil mixture.

3. The compressor system of claim 1, wherein the cooling passages extend in substantial axial relationship to a rotational axis of the electric motor.

4. The compressor system of claim 1, wherein the electric motor is defined by a rotational axis which extends essentially in a vertical direction in an installed state of the electric motor.

5. The compressor system of claim 1, wherein the housing has a housing outer side, further comprising a multiplicity of cooling fins arranged on the housing outer side.

6. The compressor system of claim 1, wherein the stator packet has end windings located within the closed cooling chamber.

7. The compressor system of claim 1, wherein the cooling chamber is bounded by walls curved to guide a flow of the coolant and arranged near the ends of the cooling passages.

* * * * *